US008646707B2

(12) United States Patent
Berger

(10) Patent No.: US 8,646,707 B2
(45) Date of Patent: Feb. 11, 2014

(54) FOOD WASTE DISPOSER WITH INDUCED DISCHARGE TURBULENCE

(75) Inventor: Thomas R. Berger, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 25 days.

(21) Appl. No.: 13/352,419

(22) Filed: Jan. 18, 2012

(65) Prior Publication Data

US 2012/0193460 A1 Aug. 2, 2012

Related U.S. Application Data

(60) Provisional application No. 61/437,228, filed on Jan. 28, 2011.

(51) Int. Cl.
*B02C 11/00* (2006.01)
*B02C 21/00* (2006.01)

(52) U.S. Cl.
USPC ..... 241/46.013; 241/DIG. 38

(58) Field of Classification Search
USPC ..... 241/46.013, 46.014, 46.016, DIG. 38
See application file for complete search history.

(56) References Cited

U.S. PATENT DOCUMENTS

| | | | | |
|---|---|---|---|---|
| 2,682,376 | A * | 6/1954 | Frank | 241/46.013 |
| 2,801,803 | A * | 8/1957 | Borman | 241/46.17 |
| 2,853,249 | A | 9/1958 | Wilder | |
| 3,165,271 | A | 1/1965 | Enright | |
| 5,340,036 | A | 8/1994 | Riley | |
| 5,533,681 | A | 7/1996 | Riley | |
| 6,007,006 | A | 12/1999 | Engel et al. | |
| 6,439,487 | B1 | 8/2002 | Anderson et al. | |
| 7,331,539 | B2 | 2/2008 | Jara-Almonte et al. | |
| 7,337,996 | B2 | 3/2008 | Hanson et al. | |
| 7,963,469 | B2 | 6/2011 | Hanson | |
| 2003/0029947 | A1 * | 2/2003 | Strutz et al. | 241/46.013 |
| 2007/0170289 | A1 | 7/2007 | Okada et al. | |
| 2008/0296421 | A1 * | 12/2008 | Wu | 241/46.013 |
| 2009/0060477 | A1 * | 3/2009 | Hirsch et al. | 388/811 |
| 2012/0193460 | A1 * | 8/2012 | Berger | 241/46.013 |

FOREIGN PATENT DOCUMENTS

EP 0625373 A2 11/1994

OTHER PUBLICATIONS

International Search Report and Written Opinion of the International Searching Authority for PCT/US2012/022569, mailed Apr. 20, 2012.
Photo A of UEB of an Anaheim disposer on sale in the US before Jan. 27, 2010.
Photo B of UEB of an Anaheim disposer on sale in the US before Jan. 27, 2010.
Photo C of UEB of an Anaheim disposer on sale in the US before Jan. 27, 2010.

(Continued)

*Primary Examiner* — Faye Francis
(74) *Attorney, Agent, or Firm* — Harness, Dickey & Pierce, P.L.C.

(57) ABSTRACT

A food waste disposer has a food conveying section that receives food waste and water; a grind section including a grind mechanism, and a motor section including a motor. The grind mechanism includes a rotating shredder plate assembly that is rotated in a grind ring to grind food waste to form a slurry of ground food waste and water. The upper end bell has a circumferentially sloped floor and the upper end bell also includes a turbulence imparting feature that imparts turbulence in the slurry as it flows through a discharge channel of the upper end bell.

8 Claims, 7 Drawing Sheets

(56) References Cited

OTHER PUBLICATIONS

GE Disposall GFC320V on sale in the US before Jan. 27, 2010 (Image of carton).

Photo of Rotating Shredder Plate of an Anaheim disposer on sale in the US before Jan. 27, 2010.

Photo of Rotating Shredder Plate (side view) of an Anaheim disposer on sale in the US before Jan. 27, 2010.

* cited by examiner

FOOD WASTE DISPOSER WITH INDUCED DISCHARGE TURBULENCE

CROSS-REFERENCE TO RELATED APPLICATIONS

This application claims the benefit of U.S. Provisional Application No. 61/437,228, filed on Jan. 28, 2011. The entire disclosure of the above application is incorporated herein by reference.

FIELD

The present disclosure relates to food waste disposers, and more particularly to facilitating the flow of a slurry of ground food waste and water through a discharge channel of a food waste disposer.

BACKGROUND

This section provides background information related to the present disclosure, which is not necessarily prior art.

A food waste disposer of the type that is disposed underneath a sink and is mounted to a drain opening of the sink typically includes a food conveying section, a motor section and a grind section. The grind section is disposed between the food conveying section and the motor section. The food conveying section conveys food waste and water to the grind section. The grind section receives and grinds the food waste and the ground food waste is discharged through a discharge opening to a tailpipe.

The grind section typically includes a grind mechanism with a shredder plate assembly and a stationary grind ring. The shredder plate assembly is connected to a shaft of an electric motor of the motor section and includes a shredder plate with one or more lugs, typically one or more pairs of lugs. The lugs may include fixed lugs that are fixed to the shredder plate, rotatable lugs that are rotatably fastened to the shredder plate and are free to rotate thereon, or both. The shredder plate is rotated relative to the grind ring via the electric motor. The grind ring is typically mounted in a housing and includes multiple spaced teeth. The teeth are vertically oriented and extend downward towards the base of the housing and are proximate an outer periphery of the shredder plate.

During operation of the food waste disposer, the food waste that is directed from the food conveying section to the grind section is forced by the lugs against the grind ring to comminute the food waste. Rotation of the shredder plate creates a centrifugal force that acts upon the lugs and enhances comminution of the food waste between the lugs and the grind ring. The sharp edges of the teeth grind the food waste into particulate matter (or ground matter). When the food waste is sufficiently ground, the food waste passes through gaps between the shredder plate and the grind ring and enters a discharge area in an upper end bell (UEB) as a food waste/water slurry ("the slurry"). The discharge area is below the shredder plate and includes a circular discharge channel in which the slurry is circulated and directed from the UEB out the tailpipe to a drain line.

A bi-directional food waste disposer rotates a shredder plate in two directions (clockwise and counter clockwise). A bi-directional food waste disposer typically includes an UEB with a discharge channel that is symmetrical with a floor of the discharge channel downward sloped from a first side of the UEB opposite a discharge opening to a second side of the UEB with the discharge opening to direct a slurry out the discharge opening. The discharge opening may be referred to as an entrance to a tailpipe. This design allows the slurry to flow downward toward the discharge opening and out the tailpipe while ensuring that fluid flow characteristics of the slurry are similar regardless of which direction the shredder plate is rotating.

A uni-directional food waste disposer rotates a shredder plate in a single direction (either clockwise or counter clockwise). A uni-directional food waste disposer typically includes an UEB with a discharge channel that is non-symmetrical with a floor of the discharge channel downward sloped from a first side of a discharge opening to a second side of the discharge opening. The floor slopes downward in a direction of rotation of a shredder plate and a slurry in the discharge channel flows downward toward the discharge opening.

The amount of time associated with transferring the slurry from a discharge area of the UEB to the tailpipe is a function of a volume and velocity of the slurry flowing through the discharge area. Rotation of the shredder plate imparts an initial velocity to the slurry as the slurry passes into the discharge area. When the slurry contains stringy waste matter or food particles of high specific gravity, the waste matter can drop out of the slurry and build up on a floor of the UEB prior to entering the tailpipe through the discharge opening.

SUMMARY

This section provides a general summary of the disclosure, and is not a comprehensive disclosure of its full scope or all of its features.

A food waste disposer has a food conveying section that receives food waste and water, a grind section including a grind mechanism, and a motor section including a motor. The grind mechanism includes a grind ring and a rotating shredder plate assembly that rotates in the grind ring to grind food waste to form ground matter that combines with the water to form a slurry. The slurry passes through gaps between the grind ring and a shredder plate of the shredder plate assembly to a discharge area in an upper end bell below the shredder plate. The upper end bell includes a circular discharge channel through which the slurry flows to a discharge opening of the upper end bell.

In accordance with an aspect of the present disclosure, a floor of the upper end bell has a circumferential downward slope from a first side of the discharge opening to a second side of the discharge opening so that the discharge channel deepens along the circumferential downward slope of the floor of the upper end bell. In this aspect, the food waste disposer is a unidirectional food waste disposer and the motor rotates the rotating shredder plate assembly when grinding food waste in a single direction that is in the direction of the circumferential downward slope of the floor of the upper end bell. At least one of the shredder plate assembly and the upper end bell include a turbulence imparting feature that imparts turbulence in the slurry as it flows through the discharge channel prior to it being discharged through the discharge opening.

In an aspect, the upper end bell includes an outer circumferential wall, an inner circumferential wall surrounding a bore, and a floor extending between the inner and outer circumferential walls, and the turbulence imparting feature includes the floor being bi-directionally sloped and having a radial downward slope from the outer circumferential wall to the inner circumferential wall in addition to the circumferential downward slope.

In an aspect, the turbulence imparting feature includes the discharge channel having a channel narrowing portion in proximity to the second side of the discharge opening where the width of the discharge channel narrows. In an aspect the turbulence imparting feature further includes the downward slope of the floor increasing in the channel narrowing portion.

In an aspect, the turbulence imparting feature includes a bump in the floor of the upper end bell. In an aspect, the turbulence imparting feature includes steps in the floor of the upper end bell. In an aspect, the turbulence imparting feature includes a plurality of ramps in the floor of the upper end bell.

In an aspect, the turbulence imparting feature includes the upper end bell having a first turbulence imparting section including a first floor section having a first slope and a first portion of the discharge channel, and a second turbulence imparting section including a second floor section having a second slope that is steeper than the first slope, and a width of the discharge channel decreasing along the first portion of the discharge channel from the discharge opening to the second turbulence imparting section. In an aspect, the turbulence imparting feature further includes a thickness of the inner circumferential wall of the upper end bell increasing in the first turbulence imparting section to a maximum thickness in a transition area between the first turbulence imparting section and the second turbulence imparting section.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
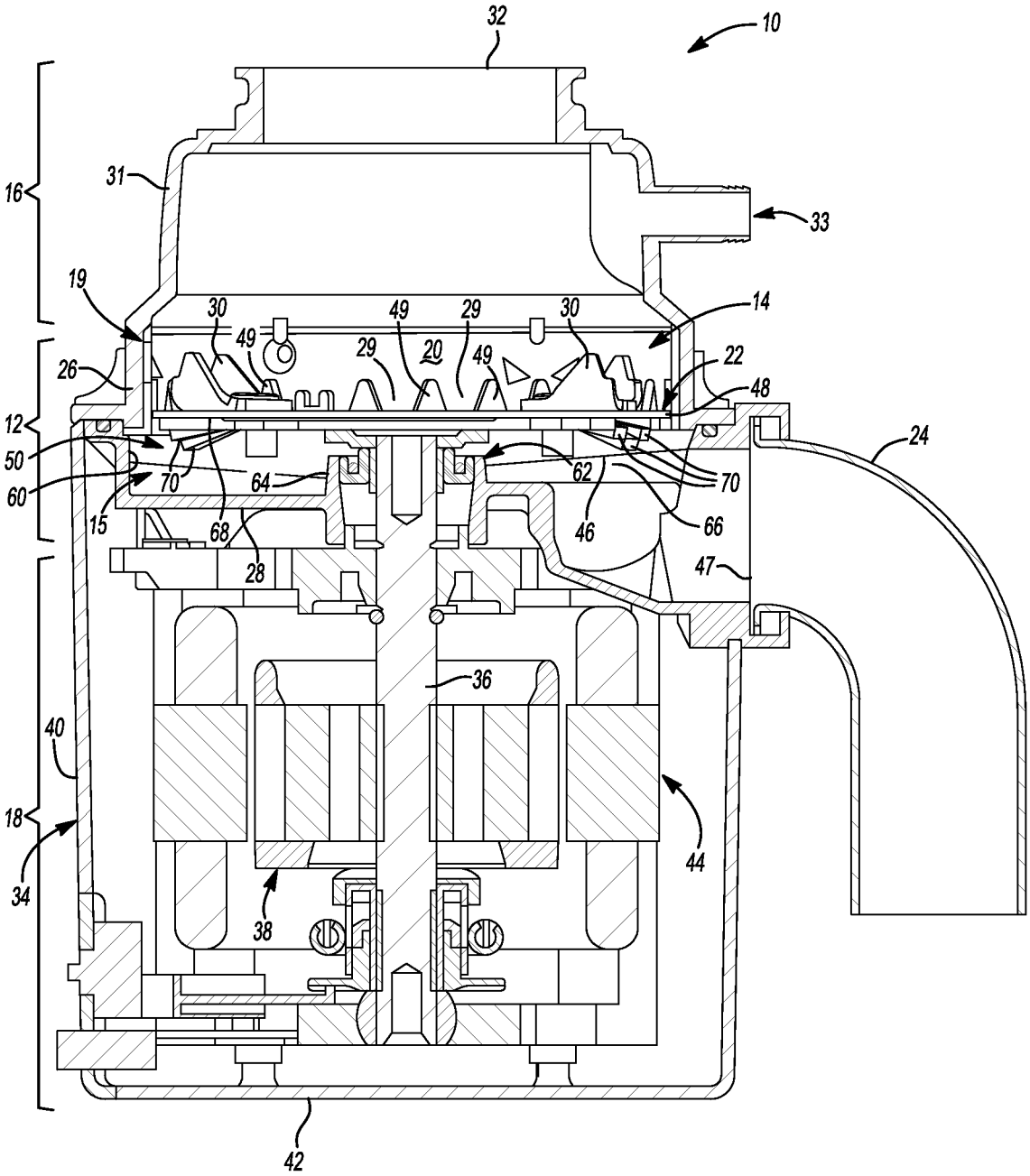
FIG. 1 shows a cross-sectional view of a food waste disposer having an upper end bell (UEB) and a shredder plate assembly in accordance with an aspect of the present disclosure.

In FIG. 1, a food waste disposer 10 is shown. The food waste disposer 10 includes a grind and discharge section 12 disposed between a food conveying section 16 and a motor section 18. The grind and discharge section 12 includes a grind section 14 and a discharge section 15. The grind section 14 includes a grind mechanism 19 with a stationary grind ring 20 and a rotating shredder plate assembly 22. During operation, the food conveying section 16 conveys food waste from, for example, a sink (not shown) to the grind section 14. The shredder plate assembly 22 is rotated via the motor section 18 to grind the food waste to form ground material. The ground material is discharged from the grind section 14 into the discharge section 15 and out a discharge outlet 47 and through a tailpipe 24 to a drain line (not shown).

The grind section 14 includes a grind housing 26 that encompasses the grind mechanism 19. The grind housing 26 may be fastened to an upper end bell (UEB) 28 of the discharge section 15 and holds the grind ring 20. The grind ring 20 is mounted in a fixed (stationary) position within the grind housing 26. The grind ring 20 includes teeth 29. The grind ring 20 may be fixedly affixed to an inner surface of the grind housing 26 by an interference fit and may be composed, for example, of galvanized steel.

The food conveying section 16 includes an inlet housing 31 with a first inlet 32. The first inlet 32 receives food waste and water. The inlet housing 31 may be a metal housing or an injection molded plastic housing. The inlet housing 31 also includes a second inlet 33 for receiving water discharged from a dishwasher (not shown). The inlet housing 31 may be integrally formed with the grind housing 26, such as by injection-molding both of the housings 26, 31 as a single component.

The motor section 18 includes a motor 34 having a rotor 38 and a stator 44. Rotor 38 rotates in stator 44 imparting rotational movement to a rotor shaft 36 of a rotor 38. Motor 34 may be an induction motor, but may be other types of motors. The motor 34 is enclosed within a motor housing 40. The motor housing 40 has a frame 42. The rotor shaft 36 is connected to and rotates the shredder plate assembly 22 within the grind ring 20.

Figure 2:
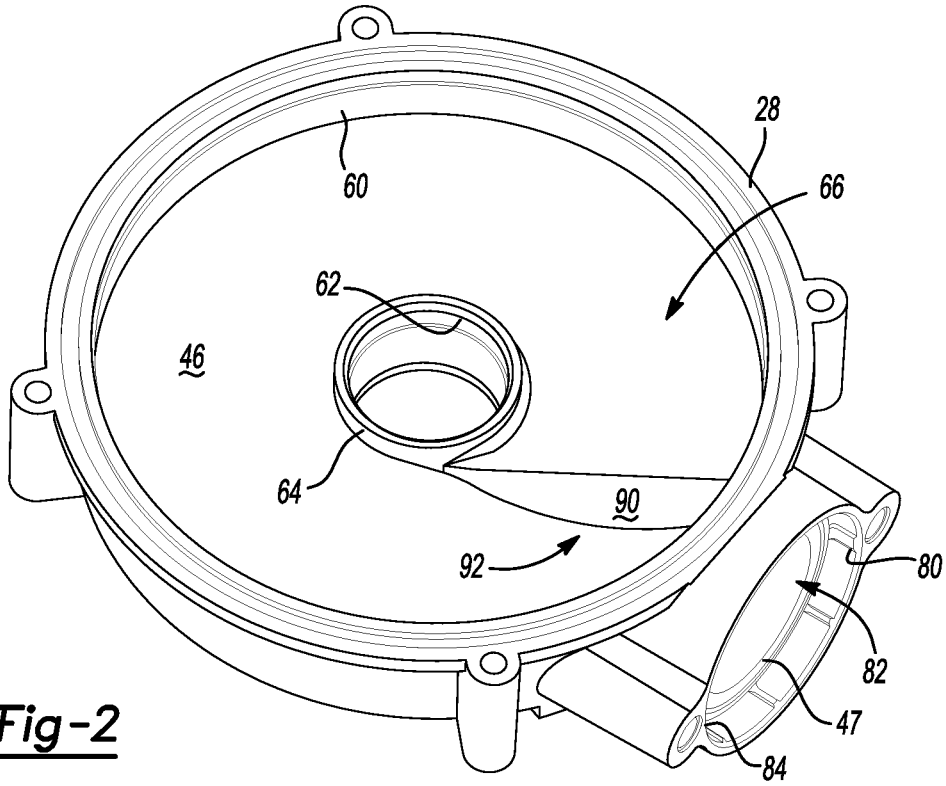
FIG. 2 shows a perspective view of the UEB of FIG. 1.
Figure 3:
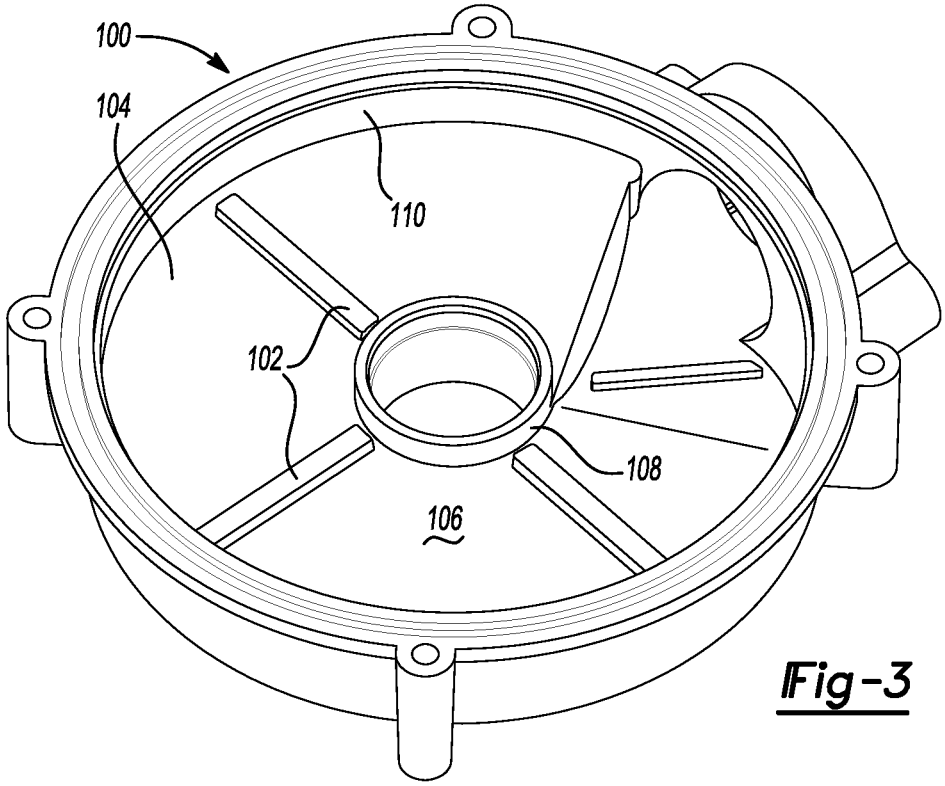
FIG. 3 shows a perspective view of another UEB with bumps in accordance with another aspect of the present disclosure.
Figure 4:
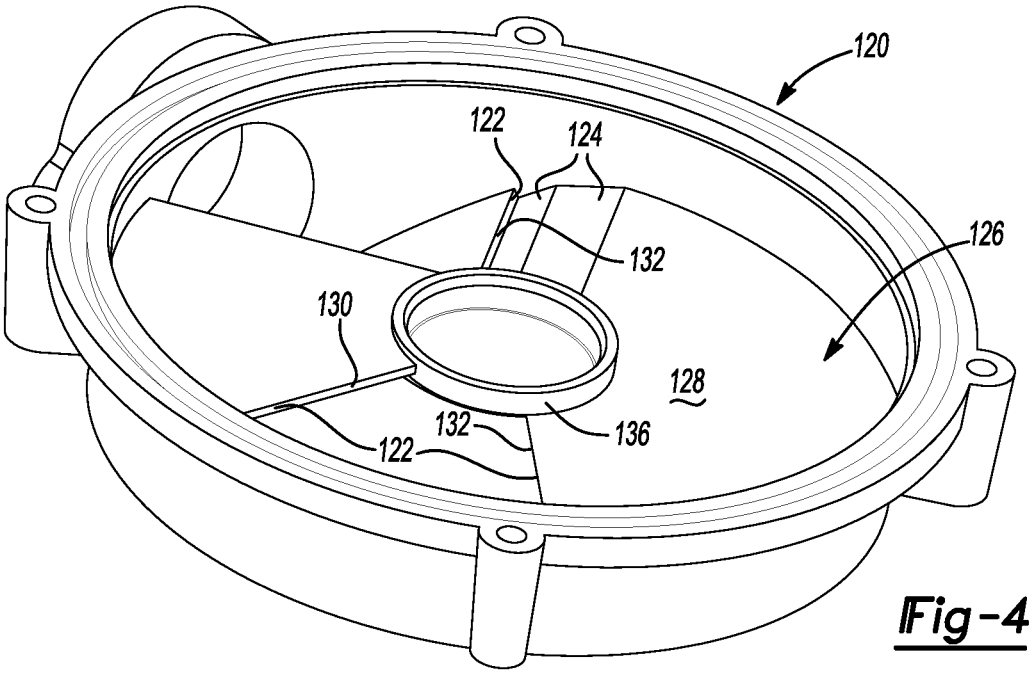
FIG. 4 shows a perspective view of another UEB with steps and ramps in accordance with another aspect of the present disclosure.
Figure 5:
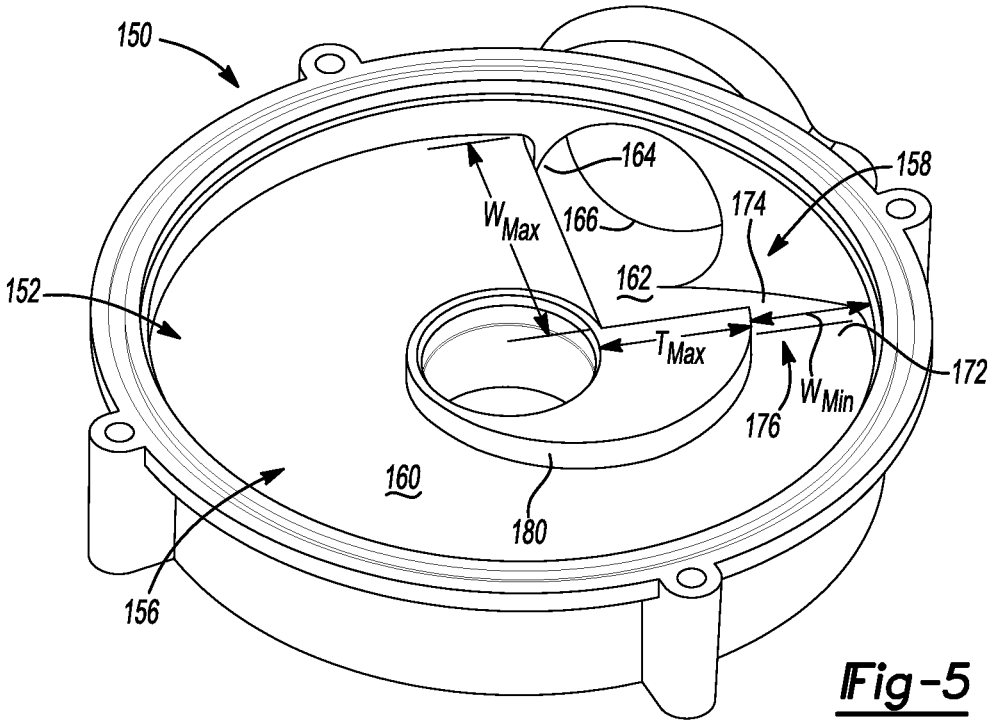
FIG. 5 shows a perspective view of another UEB with a discharge channel that has two turbulence imparting sections in accordance with another aspect of the present disclosure.

The UEB 28 is a housing that, with reference to FIG. 2, has a floor 46, an outer circumferential wall 60, and an inner circumferential wall 64 surrounding a shaft bore 62. The shaft bore 62 receives the rotor shaft 36 of the motor 34. UEB 28 includes a circular discharge channel 66 that is primarily defined by the floor 46 of the UEB 28, a bottom side 68 of the shredder plate assembly 22, the outer circumferential wall 60 of the UEB 28, and the inner circumferential wall 64 of the UEB 28. Floor 46 of UEB 28 has a downward slope, either continuous or in steps, from a first side 80 of discharge opening 82 to a second side 84 of discharge opening 82. Discharge channel 66 thus deepens along the downward slope of floor 46. The food waste disposer 10 includes one or more turbulence imparting features that impart turbulence in a slurry flowing in the discharge channel 66. The turbulence imparting features may include and or impart, for example, contractions and/or expansions in depths and/or widths of the discharge channel 66. Example turbulence imparting features are described below with respect to FIG. 2. Other turbulence imparting features are shown in FIGS. 3-5, which may be used in alternative to or in addition to the turbulence imparting features of FIG. 2.

Where floor 46 of UEB 28 is sloped, food waste disposer 10 may illustratively be a uni-directional food waste disposer. During operation of the food waste disposer 10 when it is a uni-directional food waste disposer, the shredder plate assembly 22 is rotated in a single direction, which is in the direction of the downward slope of the floor 46 of UEB 28. This aids in directing a slurry towards discharge opening 82 of the UEB 28. Due to the rotation of the shredder plate assembly 22, lugs 30 (FIG. 1) mounted on a shredder plate 48 of shredder plate assembly 22 force the food waste against the teeth 29 to grind the food waste into small particulate matter. A slurry of the particulate matter and water passes from the shredder plate assembly 22, outside a periphery of shredder plate 48, through gaps 49 between the teeth 29 to a discharge area 50 below the shredder plate assembly 22 and in the UEB 28.

Subsequent to the slurry being passed to the discharge area 50, the UEB 28 and/or the shredder plate assembly 22 induce turbulence in the slurry by causing pressure and velocity variations in the slurry. The turbulence is induced in the slurry prior to it being discharged from the UEB 28 and out the discharge opening 82.

Turbulent flow is characterized by rapid variations in pressure and velocity over both space and time and the formation of eddies or areas of swirling flow. By increasing and/or inducing turbulence in the slurry, there is less chance of particulate matter build up in the UEB 28. The UEBs and shredder plate assemblies of traditional food waste disposers do not have a direct effect upon the movement of slurry out of the UEBs to, for example, household plumbing. The UEBs and shredder plate assemblies disclosed herein include turbulence imparting features, which can increase and/or change the flow velocity of the slurry and cause turbulence in the slurry by creating pressure and velocity variations.

In FIG. 2, the UEB 28 is shown. As a first turbulence imparting feature, the floor 46 is bi-directionally sloped. The floor 46 slopes downwardly from the outer circumferential wall 60 to the inner circumferential wall 64 thus having a radially inward downward slope. The floor 46 is also sloped downward from first side 80 of the discharge opening 82, around the inner circumferential wall 64, and to at least second side 84 of the discharge opening 82. Due to the bi-sloped configuration of the floor 46, the depth of the discharge channel 66 continuously changes and gradually increases from the first side 80, around the inner circumferential wall 64, and to at least the second side 84.

Due to the downward slope of the discharge channel 66, a channel wall 90 exists across the discharge channel 66 between the inner and outer circumferential walls 60, 64. The channel wall 90 may be approximately in-line with the first side 80. This can further cause turbulence and/or direct a slurry out the discharge opening 82.

As another example turbulence imparting feature, the discharge channel 66 includes a channel narrowing section 92. The channel narrowing section 92 is located in front of the discharge opening 82, along the channel wall 90 and between the first side 80 and the second side 84, as shown. The width of channel narrowing section 92 decreases towards the discharge opening 82. This restricts fluid flow and further causes turbulence. Downward slope of the floor 46 may be increased in the channel narrowing section 92. The downward slope of the floor 46 may be greater in the channel narrowing section 92 than in other areas of the discharge channel 66. The depth of the discharge channel 66 can also vary in the channel narrowing section 92. The combination of the change in depth and width of the discharge channel 66 in the channel narrowing section 92 can aid in causing a swirling motion of a slurry therein.

In FIG. 3, a perspective view of another UEB 100 with bumps 102 is shown. The UEB 100 is similar to the UEB 28 and includes a circular discharge channel 104 that extends circumferentially along a floor 106 of the UEB 100. The bumps 102 are turbulence imparting features, which decrease the effective depth of the circular discharge channel 104 in localized areas of the floor 106. In a food waste disposer, turbulence imparting features should not serve as trapping points for particulate matter entrained in the slurry. For this reason, the bumps 102 are short enough and shaped to not cause a build up of particulate matter, and yet tall enough to cause turbulence in a slurry therein. The bumps 102 may extend partially or fully across the discharge channel between inner and outer walls 108, 110 of the UEB 100.

In FIG. 4, another UEB 120 is shown with steps 122 and ramps 124. The UEB 120 includes a circular discharge channel 126 that includes the steps 122 and the ramps 124. The steps 122 and the ramps 124 may be formed as part of a floor 128 of the UEB 120. The steps 122 may include (in the direction of rotation of shredder plate assembly 22) downward steps (one downward step 130 is shown) and/or upward steps (two upward steps 132 are shown). The steps 122 and the ramps 124 alter the depth of the circular discharge channel 126 circumferentially about an inner circumferential wall 136 of the UEB 120 and thus cause turbulence.

In FIG. 5, another UEB 150 is shown and includes a circular discharge channel 152. The UEB 150 includes a first turbulence imparting section 156 and a second turbulence imparting section 158. The first turbulence imparting section 156 has a first floor section 160 that slopes downward toward the second turbulence imparting section 158. The first floor section 160 has a first downward slope. The second turbulence imparting section 158 has a second floor section 162 with a second downward slope. The second downward slope is steeper than the first downward slope.

The first turbulence imparting section 156 includes a first portion of the circular discharge channel 152. The circular discharge channel 152 has a maximum width Wmax approximately at a first side 164 of a discharge opening 166 of the UEB 150. The width of the circular discharge channel 152 decreases in width around an inner circumferential wall 180 of the UEB 150 toward the second turbulence imparting section 158. The circular discharge channel 152 may have a minimum width Wmin at an end 172 of the first turbulence imparting section 156, a beginning 174 of the second turbulence imparting section 158, or in a transition area 176 between the first and second turbulence imparting sections 156, 158.

The width of the circular discharge channel 152 increases upon entering the second turbulence imparting section 158 from the first turbulence imparting section 156. This is due to an abrupt change in thickness in an inner circumferential wall 180 of the UEB 150 in the transition area 176. The inner circumferential wall 180 may increase in thickness from a point in the first turbulence imparting section 156 to the second turbulence imparting section 158. The inner circumferential wall 180 may have a maximum thickness Tmax at the end 172 of the first turbulence imparting section 156, the beginning 174 of the second turbulence imparting section 158, or in the transition area 176 between the first and second turbulence imparting sections 156, 158.

The second turbulence imparting section 158 includes a second portion of the circular discharge channel 152. The width of the circular discharge channel 152 may decrease from the beginning 174 of the second turbulence imparting section 158 to the discharge opening 166.

Referring back to FIG. 1, a change in the geometry of a bottom side 68 of the rotating shredder plate assembly 22 can also serve to vary the depth of the discharge channel 66. As such, the shredder plate assembly 22 may also include one or more turbulence imparting features. As an example, the shredder plate assembly 22 may include one or more downwardly protruding members, such as downwardly protruding members 70 that extend downwardly from the shredder plate assembly 22 into the discharge area 50. Some other example turbulence imparting features for a shredder plate assembly are shown in FIGS. 9-13, which may be included as an alternative to or in addition to the downwardly protruding members 70.

Figure 6:
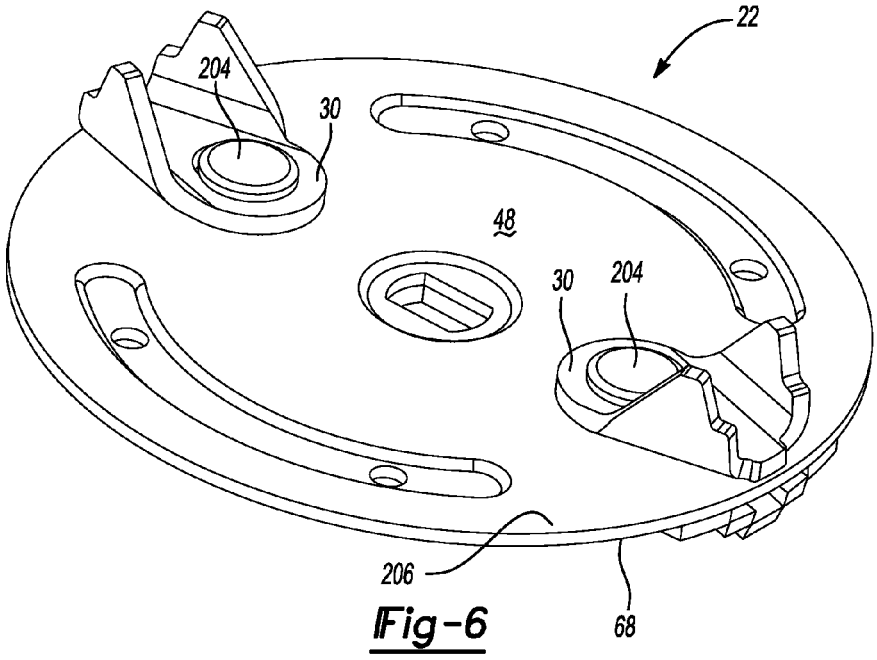
FIG. 6 shows a perspective view of the shredder plate assembly of FIG. 1.
Figure 7:
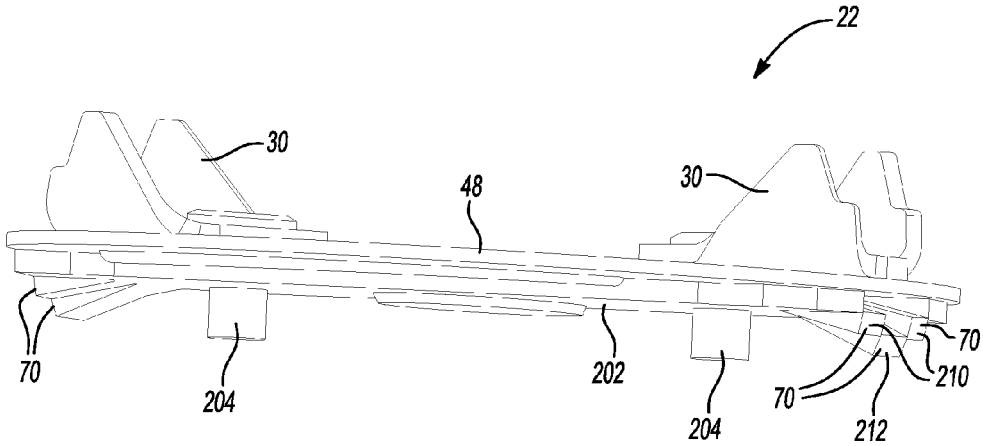
FIG. 7 shows a side view of the shredder plate assembly of FIG. 1.
Figure 8:
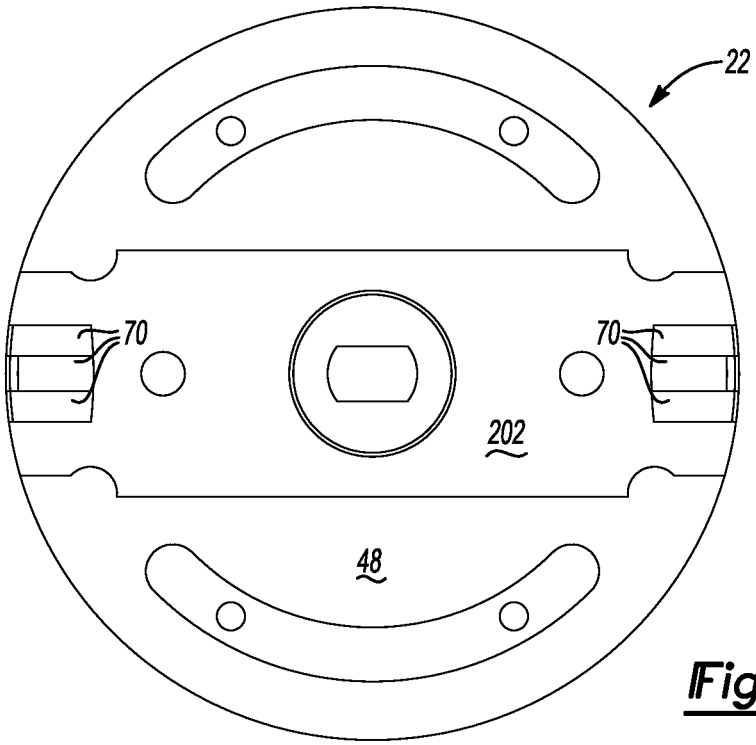
FIG. 8 shows a bottom view of the shredder plate assembly of FIG. 1.

Referring now to FIG. 1 and to FIGS. 6-8, in which views of the shredder plate assembly 22 are shown. The shredder plate assembly 22 includes the lugs 30, the shredder plate 48, a support plate 202 (FIG. 7) affixed to the bottom side 68 of the shredder plate assembly 22, and the downwardly protruding members 70 (FIG. 7). The lugs 30 are attached via fasteners 204 to a top side 206 of the shredder plate 48. The bottom side 68 may refer to a bottom side of the shredder plate 48 or a bottom side of the support plate 202.

The downwardly protruding members 70 may illustratively include a pair of downwardly protruding outer fingers 210 with a downwardly protruding center finger 212 disposed between fingers 210. The pair of downwardly protruding outer fingers 210 extend away from the bottom side 68 of shredder plate assembly 22. The downwardly protruding center finger 212 is disposed between and extends below the pair of downwardly protruding outer fingers 210 and away from the bottom side 68 of the shredder plate assembly 22. In this regard, a downward slope of the downwardly protruding center finger 212 is greater than a downward slope of the pair of downwardly protruding outer fingers 210. Fingers 210, 212 are affixed to the bottom side of shredder plate assembly 22, either to the bottom of shredder plate 48 or support plate 202. It should be understood that fingers 210, 212 could be formed integrally with either shredder plate 48 or support plate 202. The downwardly protruding center finger 212 is thus in a stepped configuration with the pair of downwardly protruding outer fingers 210 and fingers 210, 212 alter an effective depth of the discharge channel 66 as they rotate through discharge channel 66. The effective depth of the discharge channel 66 may refer to a distance between the bottom side 68 of shredder plate assembly 22 and the floor 46 of UEB 28. By altering the effective depth of the discharge channel 66, the downwardly protruding members 70, in this case, fingers 210, 212, alter the velocity and pressure of the slurry imparting turbulence to the slurry.

The distance between the shredder plate assembly 22 and the floor 46 of the UEB 28 is set to provide enough clearance for the downwardly protruding members 70 to rotate within the discharge area 50 and along the discharge channel 66. The downwardly protruding members 70 may extend at least a predetermined distance from the support plate 202 into the discharge area 50 to mechanically interact with the slurry, which also imparts turbulence in the slurry, as well as to influence velocity and discharge pressure of the slurry. The downwardly protruding members 70 may be larger and/or extend further into the discharge area 50 than, for example, undercutters (not shown), which may be used to further cut or grind food waste entering the discharge area 50.

Figure 9:
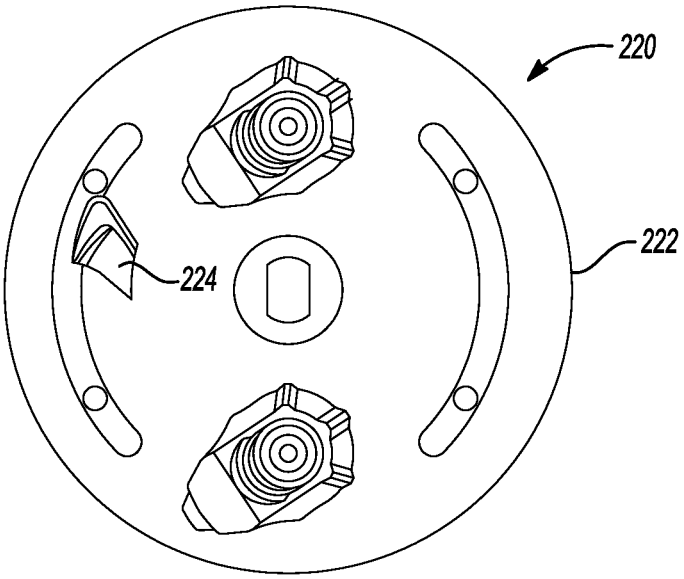
FIG. 9 shows a top view of another shredder plate assembly including a vane in accordance with an aspect of the present disclosure.
Figure 10:
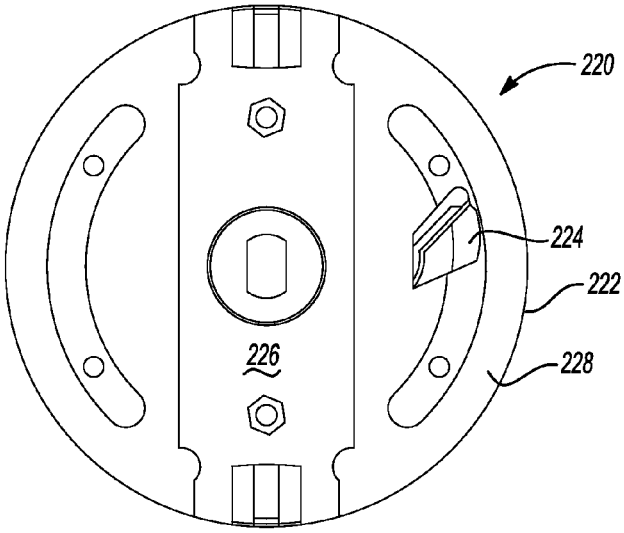
FIG. 10 shows a bottom view of the shredder plate assembly of FIG. 9.
Figure 11:
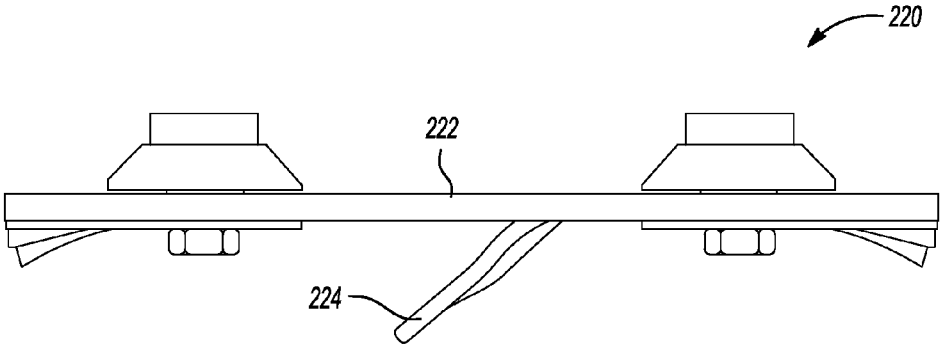
FIG. 11 shows a side view of the shredder plate assembly of FIG. 9.

In FIGS. 9-11, views of another shredder plate assembly 220 are shown. The shredder plate assembly 220 includes a shredder plate 222 with one or more vanes (a single vane 224 is shown), which is both a turbulence imparting feature and also helps move food waste through the discharge channel such as discharge channel 66. The vane 224 extends downward from the shredder plate assembly 220 into a discharge area of a UEB (e.g., one of the UEB's of FIGS. 1-5). The vane 224 can be formed as an integral part of the shredder plate 222 or a support plate 226 affixed to an underside 228 of the shredder plate 222. The vane 224 may be affixed to underside 228 of the shredder plate 222 or to an underside of the support plate 226 by fasteners (not shown) such as rivets or bolts. The geometry of the vane 224 may be designed for maximum clean out performance at a given rotational speed of the shredder plate assembly. The vane 224 may be spaced inwardly from an outer edge 229 of the shredder plate 222.

In the example implementation shown in FIGS. 9-11, the vane 224 is formed out of the shredder plate 222, which creates an opening within the shredder plate 222. Although the vane 224, as shown, has a trapezoidal geometry, a vane with a rectangular or semi-circular geometry may be used to increase pumping pressures introduced therefrom. As an alternative, the vane 224 may be formed by adding a tab to one side of the shredder plate 222 and/or bottom side of the support plate 226. The tab may be bent downward to extend into a discharge area and/or a discharge channel and form an out-of-plane vane (i.e. a vane that extends away from a plane parallel to top and/or bottom surfaces of the shredder plate 222 and/or the support plate 226). The vane 224 may be, for example, punched or stamped out of the shredder plate 222.

The vane 224 alters the effective depth of the discharge channel, which alters velocity and pressure of a slurry in the discharge channel. This imparts turbulence to the slurry while keeping heavier particulate matter entrained in the slurry and preventing drop out of particulate matter. This limits and/or prevents the build up of high specific gravity food waste, such as bones or egg shells in trap points. The vane 224 is a downwardly protruding member that mechanically interacts with the slurry in the discharge channel, which imparts turbulence to the slurry.

As discussed above, the vane 224 also helps move food waste such as fibrous material towards and out a discharge opening (e.g., the discharge opening 82 shown in FIG. 2) to, for example, a household drain line. A lower edge of the vane may include serrations or crenulations to help grab and move fibrous food waste to the discharge opening without creating food waste balls or clogs.

A vane formed as part of or affixed to the support structure of a rotating shredder plate mechanically interacts with discharged food waste to move it through a discharge channel and prevent a build-up of ground material. This is particularly effective with fibers from fibrous materials, such as soy pods, which tend to consolidate in clumps in the discharge area and create clogs. This further reduces the amount of time for the ground food waste to be discharged out of a UEB and enter a drain pipe of, for example, household plumbing.

Figure 12:
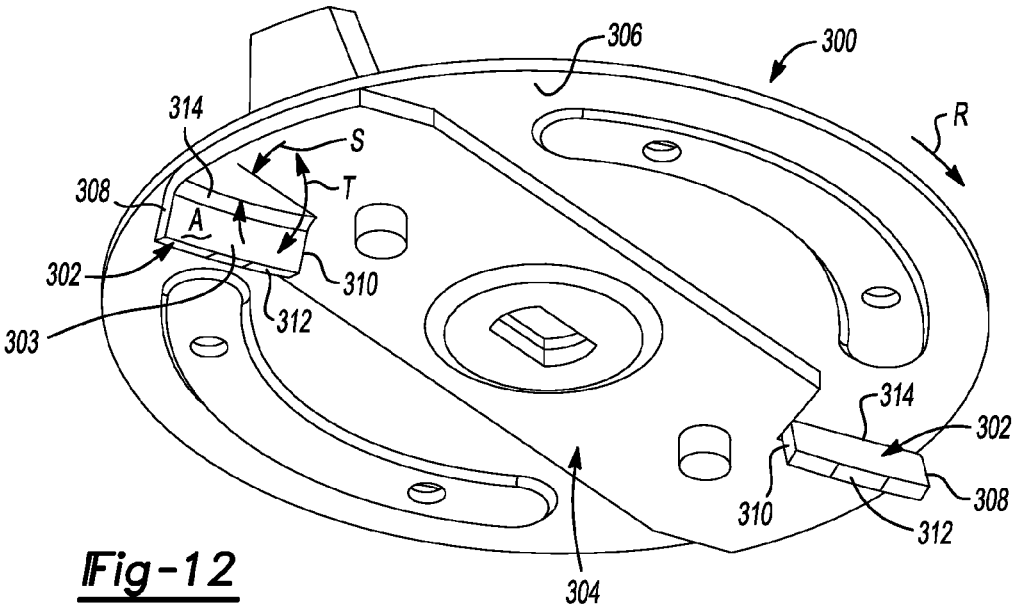
FIG. 12 shows a perspective view of shredder plate assembly with a pumping vane in accordance with an aspect of the present disclosure.

FIG. 12 illustrates an embodiment of a rotating shredder plate assembly 300 having a vane with a geometry that enhances pumping action of the slurry to aid in moving the slurry through the circular discharge channel to the discharge outlet and to increase the discharge pressure of the slurry at the discharge outlet of the food waste disposer, referred to herein as pumping vane 302. In the embodiment shown in FIG. 12, rotating shredder plate assembly 300 has a plurality of pumping vanes 302, illustratively two. It should be understood that rotating shredder plate assembly 300 could have more than two pumping vanes 302. Pumping vanes 302 are illustratively formed as an integral part of support plate 304 affixed to a bottom of shredder plate 306 and extend downwardly therefrom. In the embodiment shown in FIG. 12, pumping vanes 302 have a rectangular geometry and illustratively are rectangular tabs. Each pumping vane 302 angles radially outwardly and backwardly from a radially inner side 310 to a radially outer side 308 at a set back angle S with respect to the direction of rotation of shredder plate assembly 300 (counterclockwise as viewed from above shredder plate assembly 308 and UEB 400 as oriented in FIGS. 12 and 13, designated by R in FIG. 12). The radially outer side 308 of each pumping vane 302 thus lags the radially inner side 310 of that pumping vane 302 as shredder plate assembly 300 rotates. The set back angle S may illustratively range from 1° to 10° and may illustratively be approximately 5.25° Pumping vanes 302 are also tilted back at a tilt back angle T so that as shredder plate assembly 300 rotates, bottoms 312 of pumping vanes 302 lag tops 314 of pumping vanes 302. That is, pumping vanes 302 slope circumferentially backwardly with respect to the direction of rotation of shredder plate assembly 300 at the tilt back angle T. The tilt back angle may illustratively range from 90° to 140° with respect to the plane in which the bottom of the support plate 304 lies, and may illustratively be approximately 110°. The tilt back angle is taken from the shredder plate in front of the pumping vane to a front side 303 of the pumping vane. In embodiments where the pumping vanes have a set back angle other than 0° and a tilt back angle other than 90°, the food waste disposer is preferably a uni-directional food waste disposer. In embodiments where the set back angle is 0° and the tilt back angle is 90°, the food waste disposer may illustratively be a bi-directional food waste disposer.

Figure 13:
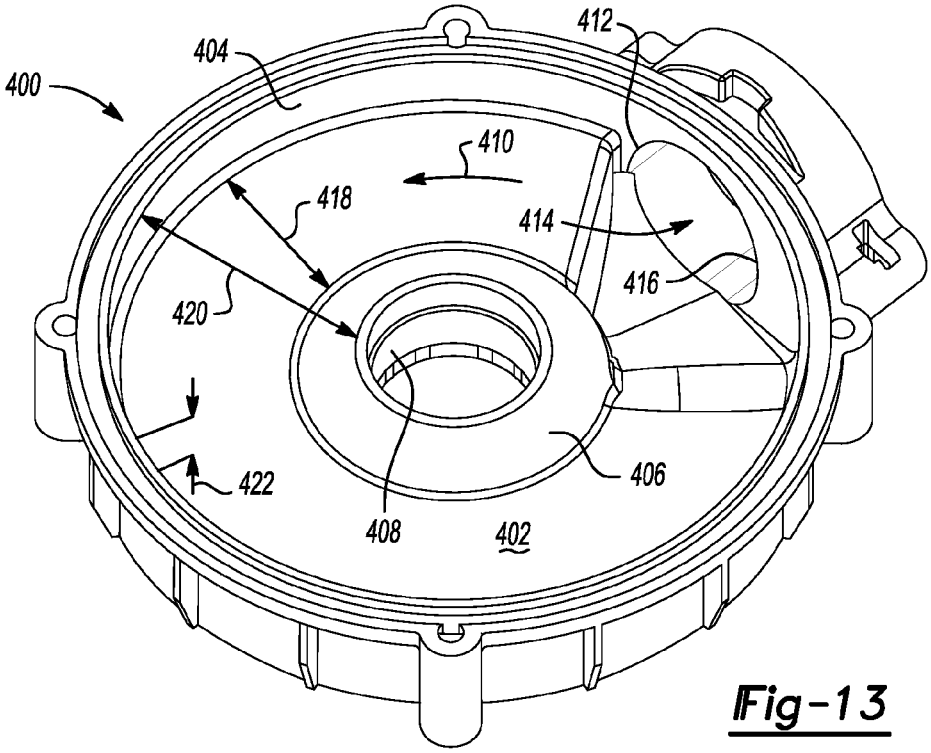
FIG. 13 shows a perspective view of a UEB with a flat floor in which the shredder plate assembly of FIG. 12 is used.

FIG. 13 illustrates an embodiment of a UEB 400 having a flat floor 402 that would preferably be used in a food waste disposer having a shredder plate assembly 300 with pumping vanes 302. UEB 400 has an outer circumferential wall 404 and an inner circumferential wall 406 surrounding a shaft bore 408. Inner circumferential wall 406 may be sloped as shown in FIG. 13. UEB 400 includes a circular discharge channel 410 that is primarily defined by floor 402, outer circumferential wall 404 and inner circumferential wall 406. Circular discharge channel 410 extends circumferentially from one side 412 of discharge opening 414 of UEB 400 to other side 416 of discharge opening 414. The term "flat" used with reference to floor 402 means that the floor 402 does not have an appreciable circumferential slope from one side 412 of discharge opening 414 to the other side 416 or just before the other side 416 of discharge opening. It may have a slight circumferential slope, such as may be caused due to manufacturing tolerances, and may have a slight radially inward slope. It should be understood that floor 402 may slope downwardly as it approaches discharge opening 414 as shown in FIG. 13.

Each pumping vane 302 has an area A defined by sides 308, 310, bottom 312 and top 314 that occupies at least twenty percent of a cross-sectional area of circular discharge channel 410. This area A may preferably occupy thirty-three percent or more of the cross-sectional area of the circular discharge channel 410. Illustratively, bottom 312 of each pumping vane 302 extends across circular discharge channel 410 close to floor 402 of UEB 400 at least sixty-five percent of a width 418 (referred to herein as bottom width 418) of circular discharge channel 410, and in an embodiment, extends across circular discharge channel 410 eighty-five percent or more of the bottom width 418 of circular discharge channel 410. Top 314 of each pumping vane 302 extends across at least thirty percent of a width 420 of circular discharge channel 410 close to a top of circular discharge channel 410 (referred to herein as top width 420). The top of circular discharge channel 410 is defined by the bottom of shredder plate assembly 300. In an embodiment, top 314 of each pumping vane 302 extends across forty percent or more of the width of circular discharge channel 410 at the top of circular discharge channel 410. Since inner circumferential wall 406 is sloped, top 314 of each pumping vane 302 extends across a smaller percentage of the top width 420 of circular discharge channel 410 than bottom 312 of the pumping vane 302 extends across the bottom width 418 of circular discharge channel 410. It should be understood that radially inner sides 310 of pumping vanes 302 could be angled to better conform to the slope of inner circumferential wall 406.

Each pumping vane 302 also extends down into circular discharge channel 410 a depth of at least fifty percent of a depth 422 of the circular discharge channel 410. In an embodiment, the depth that each pumping vane 302 extends down into circular discharge channel 410 may be sixty-five percent or more of the depth 422 of the circular discharge channel, and in another embodiment may be eighty-seven percent of the depth 422 of the circular discharge channel 410.

Viewed another way, radially outer side 308 of each pumping vane 302 is spaced from outer circumferential wall 404 of UEB 400 a distance illustratively ranging from 4.75 mm to 6.25 mm. Bottom 312 of each pumping vane 302 is spaced from floor 410 of UEB 400 a distance illustratively ranging from 0.5 mm to 5.5 mm, and in an embodiment, 1.45 mm to 4.00 mm.

A pumping vane or vanes having the above described geometry can be advantageously used in a food waste disposer in which the motor (such as motor 34) is an induction motor powered by 60 Hz AC (e.g., the United States) or 50 Hz AC (e.g., China). As is known, small induction motors (e.g., 1 horsepower or less) of the type used in food waste disposers typically have a constant nominal operating speed of 1800 RPM when powered by 60 Hz AC and a constant nominal operating speed of 1500 RPM when powered by 50 Hz AC. Since shredder plate assembly 300 is directly coupled to rotor shaft 36 of motor 34, shredder plate assembly 300 rotates as the same RPM as motor 34. In this regard, due to slip, motor 34 will operate at an RPM slightly less than the nominal constant operating speed, such as 1770-1780 RPM for an induction motor being powered by 60 Hz AC and 1470-1480 RPM for an induction motor being powered by 50 Hz AC. The above described geometry of pumping vane 302, particularly the percentage of the cross-sectional area of the circular discharge channel 410 that area A of pumping vane 302 occupies, provides an appreciable increase in the discharge pressure of the slurry (the pressure of the slurry at discharge opening 414 of UEB 400), such as an increase of at least 0.2 PSI, in food waste disposers having 60 Hz or 50 Hz induction motors with nominal operating speeds of 1800 RPM and 1500 RPM, respectively. It may for example increase the discharge pressure of the slurry from 3.1 to 3.3 PSI. This reduces the potential clogging of plumbing downstream from the discharge outlet. Applicants have found that prior art vanes that occupy a smaller percentage of the cross-sectional area of the circular discharge area than pumping vane 302 do not provide an appreciable increase in the discharge pressure of the slurry in food waste disposers having induction motors that operating at nominal constant operating speeds of 1800 RPM and 1500 RPM, respectively. It should be understood that an appreciable increase in the discharge pressure of the slurry is an increase that is enough to largely overcome the clogging of plumbing downstream of the food waste disposer due to a large ground food waste load being discharged from the food waste disposer having induction motors.

Induction motors are considered constant speed motors in that their speed remains close to constant regardless of load. As such, they do not have the metering effect of food waste disposers having motors that slow as they are loaded, such as permanent magnet motors or universal motors. In food waste disposers having motors that slow as they are loaded, when the motor is loaded by a large food waste load, the motor slows and this has the effect of metering the ground food waste load being discharged from the food waste disposer so that the amount of ground food waste being discharged from the food waste disposer tends to remain somewhat the same. In contrast, in food waste disposers having induction motors, the amount of ground food waste being discharged from the food waste disposer will vary with the amount of food waste being ground. If a large amount of food waste is being ground, a large amount of ground food waste will be discharged from the food waste disposer.

It should be understood that the greater percentage of the cross-sectional area of the circular discharge channel 410 that the pumping vanes 302 occupy, the better the pumping action providing by the pumping vanes due to increased pressurization of the slurry as the pumping vanes are moved through the slurry resulting in increased discharge pressure of the slurry.

The foregoing description has been provided for purposes of illustration and description. It is not intended to be exhaustive or to limit the invention. Individual elements or features of a particular implementation are generally not limited to that particular implementation but, where applicable, are interchangeable and can be used in a selected implementation, even if not specifically shown or described. The same may also be varied in many ways. Such variations are not to be regarded as a departure from the invention, and all such modifications are intended to be included within the scope of the invention.

What is claimed is:

1. A uni-directional food waste disposer comprising:

a food conveying section that receives food waste and water;

a grind section including a grind mechanism, the grind mechanism including a grind ring and a rotating shredder plate assembly that rotates in the grind ring to grind food waste to form ground matter that combines with the water to form a slurry that passes through gaps between the grind ring and a shredder plate of the shredder plate assembly to a discharge area in an upper end bell below the shredder plate;

the upper end bell including a circular discharge channel through which the slurry flows to a discharge opening of the upper end bell, a floor of the upper end bell having a circumferential downward slope from a first side of the discharge opening to a second side of the discharge opening so that the discharge channel deepens along the circumferential downward slope of the floor of the upper end bell;

a motor section including a motor that rotates the rotating shredder plate assembly when grinding food waste in a direction that is a direction of the circumferential downward slope of the floor of the upper end bell; and the upper end bell including a turbulence imparting feature that imparts turbulence in the slurry as it flows through the discharge channel prior to it being discharged through the discharge opening wherein the turbulence imparting feature also includes the floor being bi-directionally sloped and having a radial downward slope from an outer circumferential wall of the end bell to an inner circumferential wall of the upper end bell surrounding a bore in addition to the circumferential downward slope.

2. A uni-directional food waste disposer comprising:

a food conveying section that receives food waste and water;

a grind section including a grind mechanism, the grind mechanism including a grind ring and a rotating shredder plate assembly that rotates in the grind ring to grind food waste to form ground matter that combines with the water to form a slurry that passes through gaps between the grind ring and a shredder plate of the shredder plate assembly to a discharge area in an upper end bell below the shredder plate;

the upper end bell including a circular discharge channel through which the slurry flows to a discharge opening of the upper end bell, a floor of the upper end bell having a circumferential downward slope from a first side of the discharge opening to a second side of the discharge opening so that the discharge channel deepens along the circumferential downward slope of the floor of the upper end bell;

a motor section including a motor that rotates the rotating shredder plate assembly when grinding food waste in a direction that is a direction of the circumferential downward slope of the floor of the upper end bell; and the upper end bell including a turbulence imparting feature that imparts turbulence in the slurry as it flows through the discharge channel prior to it being discharged through the discharge opening;

wherein the turbulence imparting feature includes the discharge channel having a channel narrowing portion in proximity to the second side of the discharge opening where the width of the discharge channel narrows.

3. The food waste disposer of claim 2 wherein the turbulence imparting feature further includes the downward slope of the floor increasing in the channel narrowing portion.

4. A uni-directional food waste disposer comprising:

a food conveying section that receives food waste and water;

a grind section including a grind mechanism, the grind mechanism including a grind ring and a rotating shredder plate assembly that rotates in the grind ring to grind food waste to form ground matter that combines with the water to form a slurry that passes through gaps between the grind ring and a shredder plate of the shredder plate assembly to a discharge area in an upper end bell below the shredder plate;

the upper end bell including a circular discharge channel through which the slurry flows to a discharge opening of the upper end bell, a floor of the upper end bell having a circumferential downward slope from a first side of the discharge opening to a second side of the discharge opening so that the discharge channel deepens along the circumferential downward slope of the floor of the upper end bell;

a motor section including a motor that rotates the rotating shredder plate assembly when grinding food waste in a direction that is a direction of the circumferential downward slope of the floor of the upper end bell; and the upper end bell including a turbulence imparting feature that imparts turbulence in the slurry as it flows through the discharge channel prior to it being discharged through the discharge opening wherein the turbulence imparting feature comprises a bump in the floor of the upper end bell that extends transversely at least partially across the discharge channel.

5. A uni-directional food waste disposer comprising:

a food conveying section that receives food waste and water;

a grind section including a grind mechanism, the grind mechanism including a grind ring and a rotating shredder plate assembly that rotates in the grind ring to grind food waste to form ground matter that combines with the water to form a slurry that passes through gaps between the grind ring and a shredder plate of the shredder plate assembly to a discharge area in an upper end bell below the shredder plate;

the upper end bell including a circular discharge channel through which the slurry flows to a discharge opening of the upper end bell, a floor of the upper end bell having a circumferential downward slope from a first side of the discharge opening to a second side of the discharge opening so that the discharge channel deepens along the circumferential downward slope of the floor of the upper end bell;

a motor section including a motor that rotates the rotating shredder plate assembly when grinding food waste in a direction that is a direction of the circumferential downward slope of the floor of the upper end bell; and the upper end bell including a turbulence imparting feature that imparts turbulence in the slurry as it flows through the discharge channel prior to it being discharged through the discharge opening wherein the turbulence imparting feature comprises steps in the floor of the upper end bell that extend transversely across the discharge channel.

6. A uni-directional food waste disposer comprising:

a food conveying section that receives food waste and water;

a grind section including a grind mechanism, the grind mechanism including a grind ring and a rotating shredder plate assembly that rotates in the grind ring to grind food waste to form ground matter that combines with the water to form a slurry that passes through gaps between the grind ring and a shredder plate of the shredder plate assembly to a discharge area in an upper end bell below the shredder plate;

the upper end bell including a circular discharge channel through which the slurry flows to a discharge opening of the upper end bell, a floor of the upper end bell having a circumferential downward slope from a first side of the discharge opening to a second side of the discharge opening so that the discharge channel deepens along the circumferential downward slope of the floor of the upper end bell;

a motor section including a motor that rotates the rotating shredder plate assembly when grinding food waste in a direction that is a direction of the circumferential downward slope of the floor of the upper end bell; and the upper end bell including a turbulence imparting feature that imparts turbulence in the slurry as it flows through the discharge channel prior to it being discharged through the discharge opening wherein the turbulence imparting feature comprises a plurality of ramps in the floor of the upper end bell that extend transversely across the discharge channel.

7. A uni-directional food waste disposer comprising:

a food conveying section that receives food waste and water;

a grind section including a grind mechanism, the grind mechanism including a grind ring and a rotating shredder plate assembly that rotates in the grind ring to grind food waste to form ground matter that combines with the water to form a slurry that passes through gaps between the grind ring and a shredder plate of the shredder plate assembly to a discharge area in an upper end bell below the shredder plate;

the upper end bell including a circular discharge channel through which the slurry flows to a discharge opening of the upper end bell, a floor of the upper end bell having a circumferential downward slope from a first side of the discharge opening to a second side of the discharge opening so that the discharge channel deepens along the circumferential downward slope of the floor of the upper end bell;

a motor section including a motor that rotates the rotating shredder plate assembly when grinding food waste in a direction that is a direction of the circumferential downward slope of the floor of the upper end bell; and the upper end bell including a turbulence imparting feature that imparts turbulence in the slurry as it flows through the discharge channel prior to it being discharged through the discharge opening wherein the turbulence imparting feature includes the upper end bell having a first turbulence imparting section including a first floor section having a first slope and a first portion of the discharge channel, and a second turbulence imparting section including a second floor section having a second slope that is steeper than the first slope, and a width of the discharge channel decreasing along the first portion of the discharge channel from the discharge opening to the second turbulence imparting section.

8. The food waste disposer of claim 7, wherein the turbulence imparting feature further includes a thickness of an inner circumferential wall of the upper end bell around a bore increasing in the first turbulence imparting section to a maximum thickness in a transition area between the first turbulence imparting section and the second turbulence imparting section.

* * * * *